US005213402A

United States Patent [19]

Bernal et al.

[11] Patent Number: 5,213,402

[45] Date of Patent: May 25, 1993

[54] RECYCLING CABINET UNIT

[76] Inventors: Joseph Bernal, 129 Library Ave.; David Chapman, 104 Gibson Ave., both of Rutland, Vt. 05701

[21] Appl. No.: 786,547

[22] Filed: Nov. 1, 1991

[51] Int. Cl.[5] ..... E04F 17/12

[52] U.S. Cl. ..... 312/242; 232/43.1

[58] Field of Search ..... 312/121, 124, 242, 60; 232/43.1, 43.2, 43.5; 193/2 R, 33, 34

[56] References Cited

U.S. PATENT DOCUMENTS

| | | | |
|---|---|---|---|
| 1,225,499 | 5/1917 | Rosenberg | 312/124 X |
| 2,802,434 | 8/1957 | Dowse | 193/34 |
| 3,554,345 | 1/1971 | Mullens | 232/43.2 X |
| 3,866,824 | 2/1975 | Lewis | 232/43.2 |
| 4,221,442 | 9/1980 | Harangozo | 312/242 X |
| 4,880,156 | 11/1989 | Wallet | 232/43.1 |

*Primary Examiner*—Peter R. Brown
*Attorney, Agent, or Firm*—John J. Welch, Jr.

[57] ABSTRACT

The instant device consists of an insulated hollow interior cabinet built into a home or office wall with exterior doors flush to exterior trim on said walling within a home or office such that when said exterior doors are open, there is seen, a flat top ceiling plate, a flat bottom floor plate, two lateral wall plates and an upwardly inclining posterior plate extending from the back edge of the flat bottom floor plate and a downwardly inclining posterior plate extending from the back edge of the flat top ceiling plate such that both inclining plates meet at a complementary angle with all said plates joined to form one complete hollow interior cabinet unit, characterized likewise by the presence of a hinged drop leaf cover covering the inside face of the upwardly inclining plate when closed and which when opened through an arc exposes four circular apertures and one elliptical aperture in the upwardly inclining plate and which said device serves by way of further components, to wit, hollow chutes positioned by lipping at their respective apices within and upon said apertures and finally spacer cushions to hold said drop leaf cover when resting on said floor bottom surface in an open position, to effect ready and convenient trash and bottle separation for recycling purposes.

8 Claims, 3 Drawing Sheets

FIG. 4
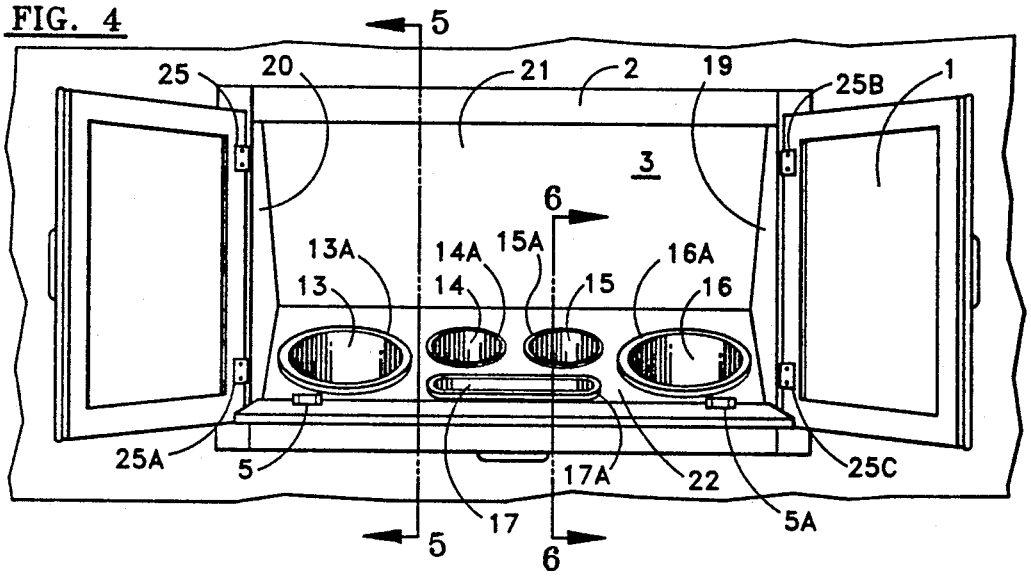
FIG. 5
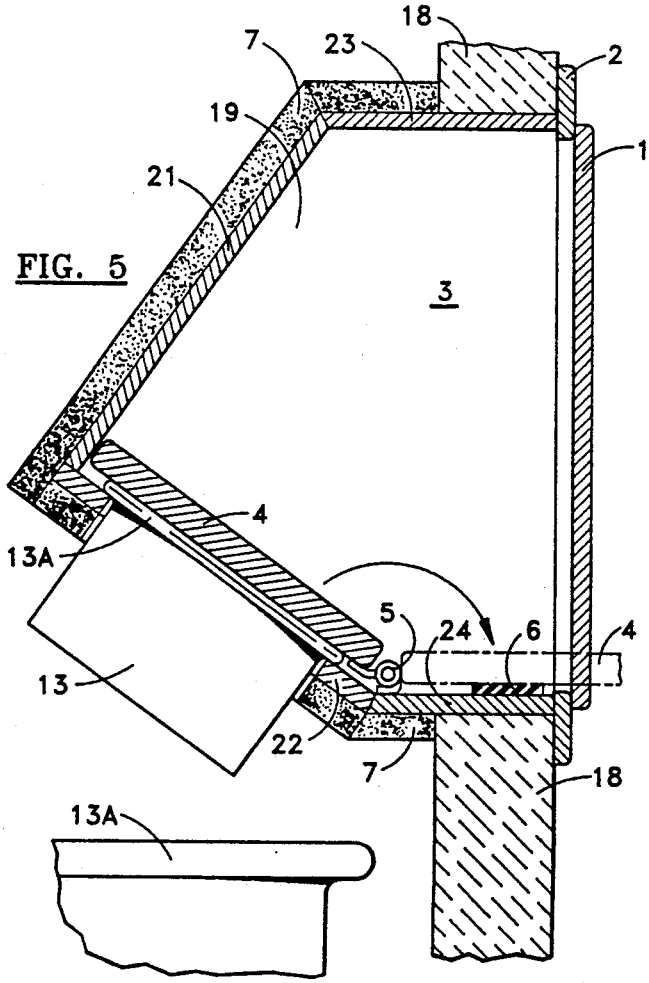
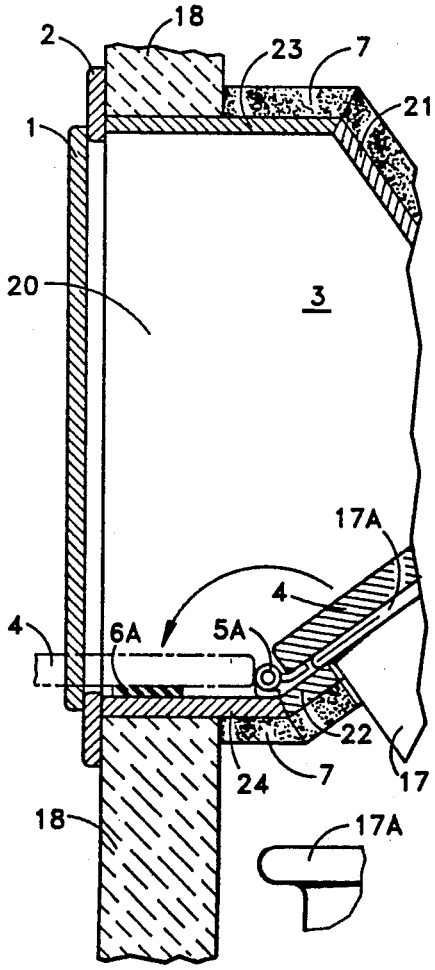
FIG. 6

RECYCLING CABINET UNIT

CROSS REFERENCES TO PRIOR APPLICATIONS

There are no other applications to refer to.

STATEMENT AS TO RIGHTS UNDER FEDERALLY SPONSORED RESEARCH AND DEVELOPMENT

There are none for consideration.

BACKGROUND OF THE INVENTION

1. The Field of Invention

The instant invention pertains to devices such as would be helpful in respect of facilitating neat, quick, convenient and necessary in-home or in-office initiation of trash recycling modalities.

This device is new, useful and unique in that it effectuates not only trash and disposable glass separation by way of compartments provided for such purposes, but, it also provides for handling such trash only once by such disposal of the same. In other words, once separated, all trash is immediately ready to be removed by a trash hauler. There is no need with the instant device as is the case with all other similar devices to retrieve each individual receptacle full of trash and remove it by hand to a place outside the home or office for subsequent removal by a trash hauler. Considerations of economy and convenience are served much more efficaciously with the instant device than with any of the others currently in vogue.

2. A Brief Description of Possible Prior Art

Please note the following references in respect of the same:

a) The Home Recycling Center; Carol Wright gifts, 340 Applecreek Road, P.O. Box 8521, Lincoln, NE 68544 (Please note Exhibit A).

b) Possible References:

| | Inventor | Invention | Patent No. | Date |
|---|---|---|---|---|
| 1. | Johnson | Multiple Compartment Refuse Container | 3,893,615 | 7/8/75 |
| 2. | Pluss | Container Particularly for Collecting Products to be Recycled | 4,114,776 | 9/19/78 |
| 3. | Keppeler | In Ground Trash Receptacle | 4,775,066 | 10/4/88 |
| 4. | Hayes | Trash Bin Cart and Bin Assembly | 4,821,903 | 4/18/89 |
| 5. | Zipper | Paper Separation Device For Waste Containers | 4,860,910 | 8/29/89 |
| 6. | McCarthy | Sectionized Trash Receptacles | 4,867,328 | 9/19/89 |
| 7. | Heller | Multi-Compartment Refuse Container | 4,874,111 | 10/17/89 |
| 8. | Lombardi, et al | Compartmentalized Separating Container | 4,893,719 | 1/16/90 |
| 9. | Jones | Compartmented Waste Receptacle | 4,893,722 | 1/16/90 |
| 10. | L. Kubersky & H. Shrock | Compartment Receptacle | 992,006 | 5/9/11 |
| 11. | J. Kovachevich | Waste Receptacle for Domestic Use | 1,281,587 | 10/15/18 |

Comments

As can be noted from an inspection of the above-cited references, none of them teach what is the essential feature of the instant invention; namely a means for effectuating, in essence, trash separation and, in effect, immediate disposal from inside the home or office of separated trash into the hands of an outside trash hauler. Once again, respectfully submitted, the instant invention serves the interests of convenience and economy of action so markedly better than any other such device that undoubtedly unlike with any of the other devices, the interests of ready separation as a predicate for ultimately efficient recycling are greatly advanced.

In these regards, please note additional comments below under the rubric entitled, The Object of the Invention.

A SUMMARY OF THE INVENTION

1. A Brief Description of the Invention

The instant invention is meant to be built right into a wall of a house or office building. Current home or office walling can readily be reconstructed to accommodate the device. Building plans for new homes or offices could be drawn so as to readily incorporate the instant invention into such home or office walling.

Within a home or office flush against a selected wall is a double cabinet door (two door) assembly. This cabinet door assembly readily opens into a hollow interior cabinet which is an externally insulated housing unit characterized by inter alia the presence of a flat bottom floor plate, a flat top ceiling plate, two lateral wall plates and two posterior plates, to wit, an upwardly inclining posterior plate extending from the back edge of the flat bottom floor plate and a downwardly inclining posterior plate extending from the back edge of the flat top ceiling plate such that both inclining plates meet at a complementary angle with all such plates jointed together, which said hollow interior cabinet is actually built into the selected home or office wall such that the greatest portion of its volume actually lies outside of the said walling into which said instant invention would have been installed. The said cabinet door assembly is hinged to trim molding affixed to said cabinet. There is, moreover, on the inside face of the upwardly inclining posterior plate of the hollow interior cabinet, a drop leaf floor cover on two hinges proximate to the juncture of the floor plate and upwardly inclining posterior plate, each located at the respective lateral ends of the floor plate, which drop leaf cover when grasped by a handle on its top, opens from a closed position resting flush on the inside face of the upwardly inclining posterior plate of the hollow interior cabinet through an arc to expose apertures in the inside face of the upwardly inclining posterior plate through which trash and bottles can be dropped by an occupant within a home or office into receptacles located below them but on the outside of said walling. Directly behind the cabinet door assembly opening into the hollow interior cabinet proximate to each end of the front edge of the flat bottom floor plate of the hollow interior cabinet just adjacent to each of the two lateral plates of the hollow interior cabinet are one each of a total of two spacer cushions to hold the drop leaf floor cover as well as to facilitate accessibility to the apertures when the drop leaf cover is pulled through an arc from its resting position flush against the inside face of the upwardly inclining posterior plate of the hollow interior cabinet to an open position flush with the inside face of the flat bottom floor plate. An opening of the drop leaf floor cover, as previously noted reveals the presence of apertures in the upwardly inclining posterior plate of the hollow interior cabinet. Each of four of the apertures is circular in shape and holds a hollow cylindrically shaped chute in-situ by virtue of reinforced lipping which is found at the tops or apices of each such chute. In front of these four apertures is an elliptical aperture which likewise holds a hollow elliptically shaped chute, the top or apex of which is also characterized by the presence of reinforced lipping serving to hold elliptically shaped chute in-situ within the elliptical aperture. Two of the initial four circular apertures and concomitant cylindrically shaped chutes are of a greater diameter than the other two. The two greatest diameter are at the ends of the row of the four apertures. The two apertures and chutes of greatest diameter accommodate disposal of large glass bottles and large plastic bottles respectively. The two inner apertures and chutes serve to facilitate disposal of cans and smaller bottles respectively. All of the chutes as previously noted are designed to lead directly into trash receptacles located outside of the home or office that would be picked up and emptied on a regular basis by a trash hauler. For aesthetic purposes, the exterior of the hollow interior cabinet, chutes and trash receptacles could all be housed by a shed built on the outside of the walling into which the invention would have been built.

2. The Object of the Invention

There is an inherent resistance on the part of people to indulge in in-house trash separation. Yet such separation is becoming more and more necessary as land fill space becomes less and less available, and as non-biodegradable plastics and glass become, absent recycling, more and more bountiful. The instant device makes separation a very easy task to perform. Rummaging through waste baskets to separate trash is no longer a problem with the instant device built right into a kitchen or other suitable wall. Items of trash once handled are simply, immediately dumped into the appropriate chute within the instant built-in device.

In conclusion, the instant device is clearly useful from a standpoint of economy and efficiency of disposability of trash items. It is likewise new and unique insomuch as it is the first of such devices to have incorporated within it the means for, in effect, succinctly stated, dumping separated trash directly into outside trash receptacles without any need to haul individual, cumulative in-house trash receptacles outside of the house periodically to be picked up by a trash hauler.

A BRIEF DESCRIPTION OF THE DRAWINGS

FIG. 4 is a frontal view of the device as built into an exterior wall of an office or a dwelling place showing the device's open cabinet door assembly, circumscribed trim molding and showing the interior of the device, a cabinet, opened drop leaf floor cover, hinges, and the interiors of chutes, as well as chute lips on each chute.

FIG. 5 is a cutaway cross-sectional view along Section 5—5 in FIG. 4, to wit a sectional view of the device as built into an exterior wall of an office or a dwelling place. Cabinet door assembly, trim molding, the far right lateral wall plate of the device, a cabinet, drop leaf floor cover and a hinge are herein shown. Also shown is one of two spacer cushions. External insulation about the exterior of the device, a cabinet is also shown. A chute and its chute lip are also herein shown.

FIG. 6 is a cutaway cross-sectional lateral view, to wit, a partial section along Section 6—6 in FIG. 4 of the device as built into an exterior wall of an office or a dwelling place. Cabinet door assembly, trim molding, the far left lateral wall of the device, a cabinet, drop leaf floor cover, and a hinge are herein shown. Also shown is one of two spacer cushions. External insulation about the exterior of the device, a cabinet is also shown. A chute and its chute lip are also herein shown.

Figure 7:
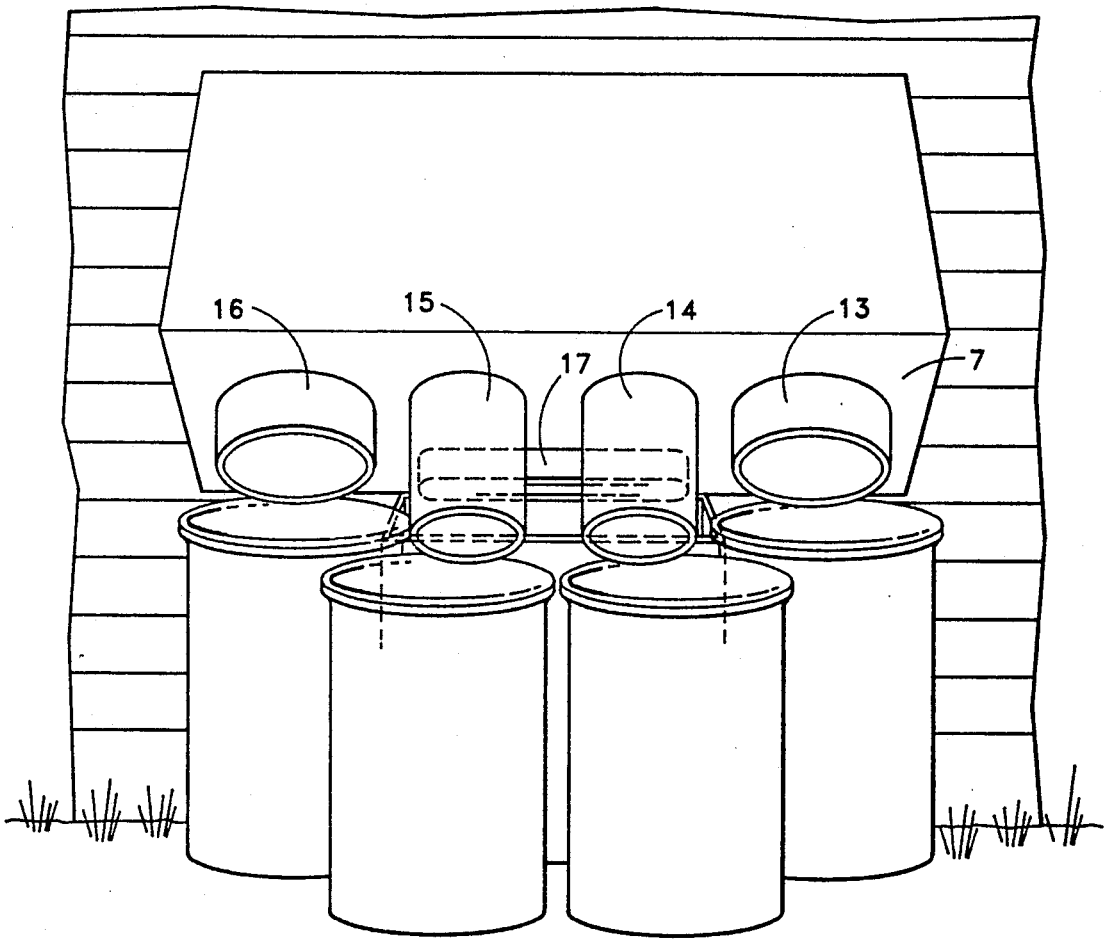

FIG. 7 shows the device in a posterior view looking at it from the exterior of the wall of an office or a dwelling place into which it would have been built. There is shown external insulation and all of the device's chutes. Bottle and trash receptacles under the said chutes are also shown.

A DESCRIPTION OF THE PREFERRED EMBODIMENTS

Figure 1:
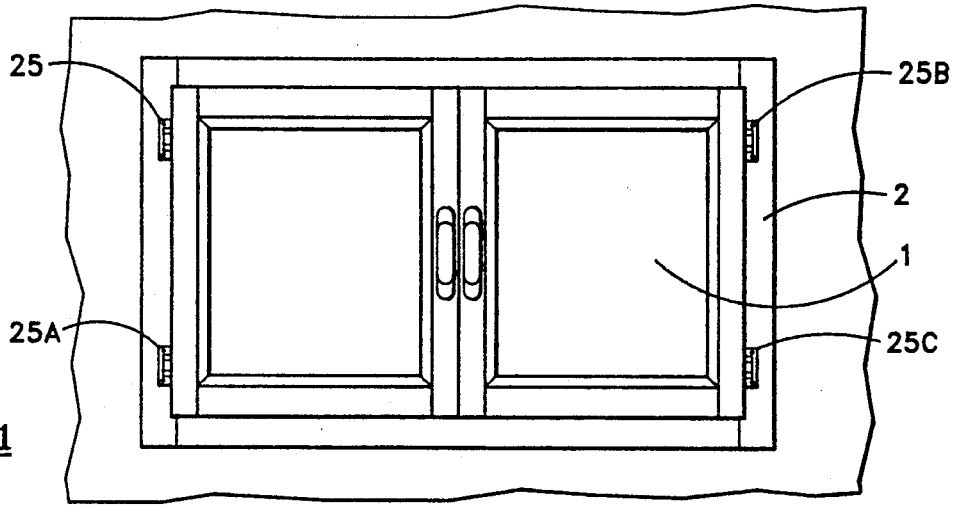
FIG. 1 is a frontal view of the device as built into an exterior wall of an office or a dwelling place showing the device's closed hinged cabinet door assembly circumscribing trim molding.
Figure 2:
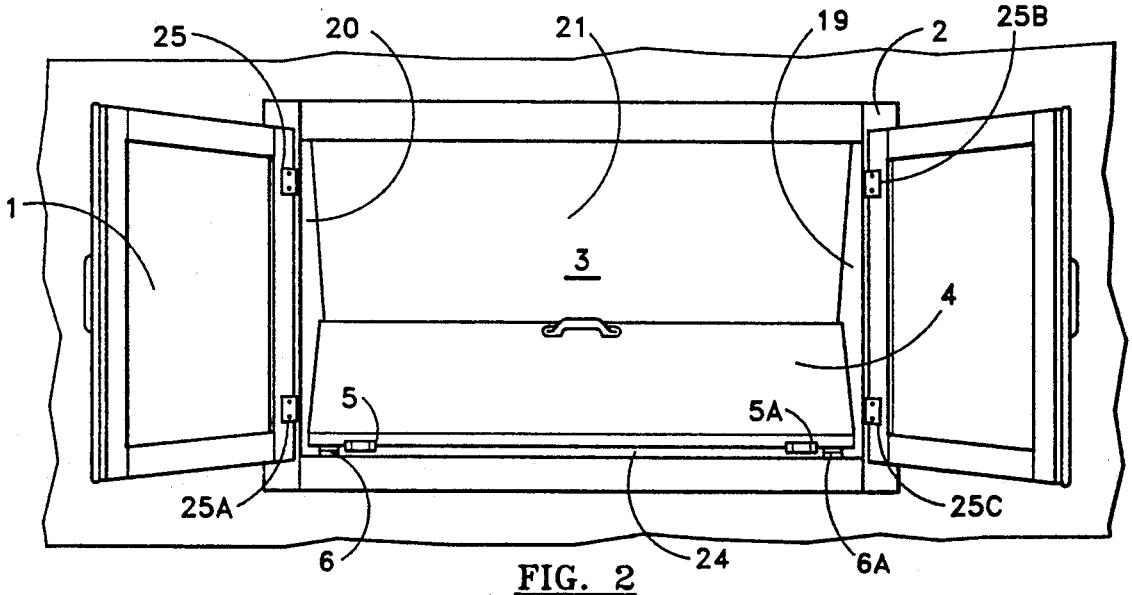
FIG. 2 is a frontal view of the device as built into an exterior wall of an office or a dwelling place showing the device's open cabinet door assembly circumscribed by trim molding and showing the interior of the device, a cabinet, unopened drop leaf floor cover and two hinges and two spacer cushions.
Figure 3:
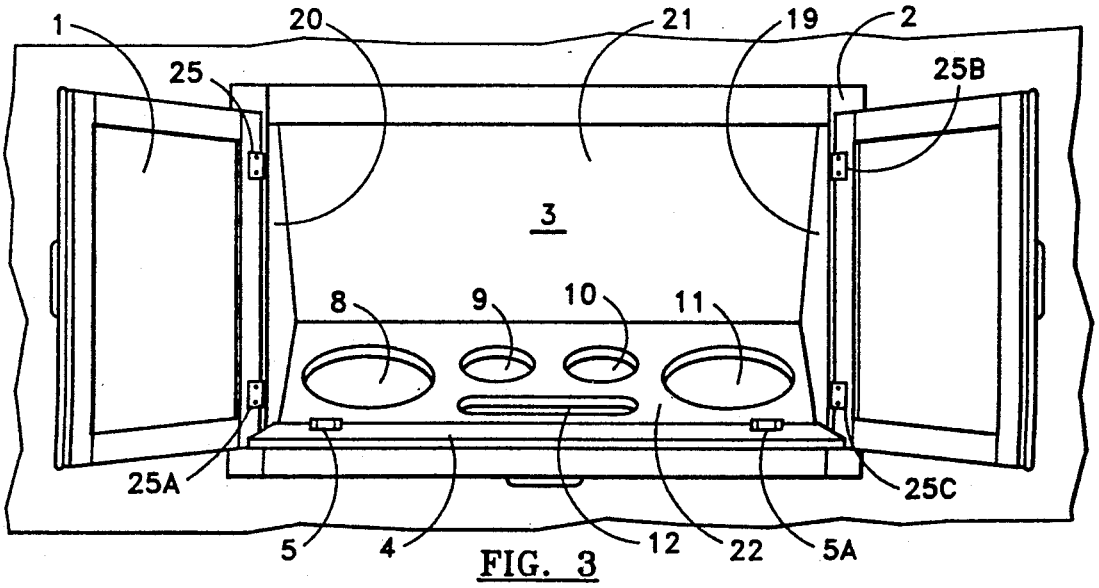
FIG. 3 is a frontal view of the device as built into an exterior wall of an office or a dwelling place showing the device's open cabinet door assembly circumscribed trim molding and showing the interior of the device, a cabinet opened drop leaf floor cover, hinges, and apertures.

The instant invention is in best mode characterized by the coincidence in unique combination of various features. To begin with, with respect to FIG. 1 and FIG. 2 of the drawings, a cabinet door assembly (1) is affixed by hinges (25), (25*a*), (25*b*) and (25*c*) to trim molding (2) which for aesthetic and support purposes is affixed to a hollow interior cabinet (3). Said hollow interior cabinet, (3) as shown in FIG. 5 has a flat top ceiling plate (23), a flat bottom floor plate (24), and as shown in FIG. 3 two lateral wall plates, to wit, a right lateral wall plate (19), a left lateral wall plate (20) and as seen in FIG. 5 an upwardly inclining posterior plate (22) extending from the back edge of the flat bottom floor plate (24) and a downwardly inclining posterior plate (21) extending from the back edge of the flat top ceiling plate (23) such that both inclining plates meet at a complementary angle, and such that all such plates are joined together to form one complete unit. The hollow interior cabinet (3) as shown in FIG. 5 is everywhere externally covered by insulating material (7). Over the inside face portion of the upwardly inclining posterior plate (22) of the hollow interior cabinet (3) as shown in FIG. 2 there is to be found a drop leaf floor cover (4) supported by each of two hinges (5) and (5*a*) both located at the respective lateral ends of the floor plate (24) proximate to the juncture of the floor plate (24) and upwardly inclining posterior plate (22) of said hollow interior cabinet (3). There is as shown in FIGS. 5 and 6 a pair of spacer cushions (6) and (6*a*) proximate to each end of the front edge of the hollow interior cabinet, (3)'s flat bottom floor plate (24) serving to support drop leaf floor cover (4) when it is lifted by a user of the instant invention from a closed position flush to the interior face of the upwardly inclining posterior plate (22) of hollow interior cabinet, (3) through an arc of roughly 135° to a fully open position lying flush to the inside face of the flat bottom floor plate (24) of hollow interior cabinet (3). Within the upwardly inclining posterior plate (22) of hollow interior cabinet (3) as shown in FIG. 3 there are to be found once said drop leaf floor cover (4) is pulled to an open position, five apertures, to wit, circular chute opening (8), circular chute opening (9), circular chute opening (10), circular chute opening (11), and centered in front of these four apertures, an elliptical chute opening (12). As seen in FIG. 4 chute opening (8) holds hollow cylindrically shaped chute (13) via reinforced lipping (13*a*) circumscribing the apex of cylindrically shaped chute (13). Chute opening (9) likewise therein shown holds hollow cylindrically shaped chute (14) via reinforced lipping (14*a*) circumscribing the apex of cylindrically shaped chute (14). Chute opening (10) likewise therein shown holds hollow cylindrically shaped chute (15) via reinforced lipping (15*a*) circumscribing the apex of cylindrically shaped chute (15). Chute opening (11) likewise therein shown holds hollow cylindrically shaped chute (16) via reinforced lipping (16*a*) circumscribing the apex of cylindrically shaped chute (16). Finally, elliptical chute opening (12) as therein also shown holds elliptically shaped chute (17) via reinforced lipping (17*a*) circumscribing the apex of elliptically shaped chute (17). All of these chutes as shown in FIG. 7 serve to extend directly into bottle and trash receptacles located below them and outside of home or office walling into which the instant invention can be encased or built.

What is claimed is:

1. A recycling cabinet unit, comprising:

a. a hollow cabinet unit made up of a flat bottom floor plate, a flat top ceiling plate, two lateral wall plates permanently joined to said flat bottom floor plate and said flat top ceiling plate and an upwardly inclining posterior plate extending from and permanently joined to the back edge of said flat bottom floor plate as well as being permanently joined to said two wall lateral plates together with a downwardly inclining posterior plate extending from and permanently joined to the back edge of said flat top ceiling plate as well as being permanently joined to said two lateral wall plates which said inclining posterior plates are permanently joined at a complementary angle;

b. four circular apertures all in a row cut into said upwardly inclining posterior plate;

c. one elliptical aperture cut into said upwardly inclining posterior plate;

d. four hollow cylindrically shaped chutes permanently mounted one chute at a time to the circumferences of the tops of each of said four circular apertures;

e. one hollow elliptically shaped chute permanently mounted to the perimeter of the top of said elliptical aperture.

2. The recycling cabinet unit of claim 1 whereby each symmetrical half of a two door cabinet door assembly is hinged to each of the front edges respectively of each of said lateral wall plates.

3. The recycling cabinet unit of claim 1 whereby the top edges of said four hollow cylindrically shaped chutes and the top edge of said hollow elliptically shaped chute are circumscribed by everted reinforced lipping.

4. The recycling cabinet unit of claim 1 whereby said elliptical aperture is cut into said upwardly inclining posterior plate anterior to said four circular apertures.

5. The recycling cabinet unit of claim 1 whereby a drop leaf cover with handle amenable to being opened through an arc is suitably hinged proximate to the juncture of said flat bottom floor plate and said upwardly inclining posterior plate.

6. The recycling cabinet unit of claim 1 whereby each of two spacer cushions are permanently located one at a time at either end of and proximate to the front edge of said flat bottom floor plate.

7. A recycling cabinet unit, comprising:

a. a hollow cabinet unit made up of a flat bottom floor plate, a flat top ceiling plate, two lateral wall plates permanently joined to said flat bottom floor plate and said flat top ceiling plate and an upwardly inclining posterior plate extending from and permanently joined to the back edge of said flat bottom floor plate as well as being permanently joined to said two wall lateral plates together with a downwardly inclining posterior plate extending from and permanently joined to the back edge of said flat top ceiling plate as well as being permanently joined to said two lateral wall plates which said inclining posterior plates are permanently joined at a complementary angle;

b. a first hinge located at one end of said flat bottom floor plate proximate to the juncture of said flat bottom floor plate and said upwardly inclining posterior plate;

c. a second hinge located at the other end of said flat bottom floor plate proximate to the juncture of said flat bottom floor plate and said upwardly inclining posterior plate;

d. a drop leaf cover with handle amenable to being opened through an arc affixed to said hinges;

e. four circular apertures all in a row cut into said upwardly inclining posterior plate;

f. one elliptical aperture cut into said upwardly inclining posterior plate;

g. four removable hollow cylindrically shaped chutes positioned one chute at a time with their top edges respectively flush to the circumferences of the tops of each of said four circular apertures;

h. everted reinforced lipping circumscribing the top edges of each said hollow cylindrically shaped chute;

i. one removable hollow elliptically shaped chute positioned at its top edge flush to the perimeter of the top of said elliptical aperture;

j. everted reinforced lipping circumscribing the top edge of said elliptically shaped chute;

k. a first spacer cushion located at one end of and proximate to the front edge of said flat bottom floor plate;

l. a second spacer cushion located at the other end of and proximate to the front edge of said flat bottom floor plate;

m. trim molding affixed to the front edges of said lateral wall plates, said flat top ceiling plate and said flat bottom floor plate.

8. The recycling cabinet unit of claim 7 whereby each symmetrical half of a two door cabinet assembly is hinged to said trim molding.

* * * * *